US006256185B1

(12) United States Patent
Maller

(10) Patent No.: US 6,256,185 B1
(45) Date of Patent: Jul. 3, 2001

(54) LOW VOLTAGE DIRECT CONTROL UNIVERSAL PULSE WIDTH MODULATION MODULE

(75) Inventor: Dennis A. Maller, Racine, WI (US)

(73) Assignee: Trombetta, LLC, Menomonee Falls, WI (US)

( * ) Notice: Subject to any disclaimer, the term of this patent is extended or adjusted under 35 U.S.C. 154(b) by 0 days.

(21) Appl. No.: 09/364,194

(22) Filed: Jul. 30, 1999

(51) Int. Cl.[7] ..... H01H 47/00

(52) U.S. Cl. ..... 361/152; 361/84; 361/91.5; 361/187; 361/194; 361/195; 361/196; 361/210

(58) Field of Search ..... 361/84, 160, 166–167, 361/170, 168.1, 169.1, 187, 194–195, 196–197, 91.5, 210, 152

(56) References Cited

U.S. PATENT DOCUMENTS

| | | | | |
|---|---|---|---|---|
| 4,295,177 | | 10/1981 | Woodhouse et al. . | |
| 4,384,213 | | 5/1983 | Bogel . | |
| 4,620,259 | | 10/1986 | Oshizawa . | |
| 4,620,260 | | 10/1986 | Oshizawa et al. . | |
| 4,661,766 | * | 4/1987 | Hoffman et al. | 323/287 |
| 4,949,215 | * | 8/1990 | Studtmann et al. | 361/154 |
| 4,964,014 | | 10/1990 | Boe et al. . | |
| 5,255,152 | * | 10/1993 | Estes, III et al. | 361/160 |
| 5,489,831 | | 2/1996 | Harris . | |
| 5,546,268 | | 8/1996 | Hurley et al. . | |
| 5,621,603 | | 4/1997 | Adamec et al. . | |
| 5,647,387 | | 7/1997 | Tsutsui . | |
| 5,703,748 | * | 12/1997 | Fulks et al. | 361/153 |
| 5,703,750 | | 12/1997 | Kim et al. . | |
| 5,748,431 | | 5/1998 | Goodnight et al. . | |
| 5,754,386 | | 5/1998 | Barbour et al. . | |
| 5,757,605 | | 5/1998 | Furukawa . | |
| 5,861,746 | * | 1/1999 | Ensten | 324/207.16 |

* cited by examiner

*Primary Examiner*—Michael Sherry
(74) *Attorney, Agent, or Firm*—Ryan Kromholz & Manion, S.C.

(57) ABSTRACT

An electrical control module and circuit for controlling a solenoid. The control circuit provides a constant voltage to a solenoid for a predetermined time period after which a pulse width modulated voltage is supplied. The circuit further includes components for reverse polarity protection, transient voltage protection, low gate drive voltage protection, reduced heat dissipation and improved magnetic drive under low input voltage conditions during application of the pulse width modulated voltage. The module may be used in conjunction with a single coil or a dual coil solenoid. The circuit may be utilized on a 12 volt or a 24 volt electrical system without adjustment.

26 Claims, 4 Drawing Sheets

LOW VOLTAGE DIRECT CONTROL UNIVERSAL PULSE WIDTH MODULATION MODULE

FIELD OF THE INVENTION

The present invention relates to electrical control modules and specifically to electrical control circuits for use with solenoids.

BACKGROUND OF THE INVENTION

A solenoid is a common electrical device used to convert electrical energy into mechanical energy. Solenoids are well known in the art and are often utilized as a means of moving a component a predetermined distance at a predetermined time. In its most basic form, a solenoid is an electromechanical device that converts electrical energy into linear or rotary motion. Electrical voltage passes through a coil of insulated copper wire producing a magnetic field, which moves a ferromagnetic plunger located within the core of the coil. Steel parts surround the coil to contain the flux path for maximum pull, push or rotational force. A solenoid can be used to open a valve, activate a switch, apply a brake or a number of other activities where mechanical movement is required and only an electrical energy source is available or practical.

A typical solenoid comprises a steel frame or shell that surrounds the coil of wire and directs the flux path. The coil assembly, when energized with an electrical voltage, creates the magnetic lines of force. A plunger, located within the coil assembly, reacts to the magnetic pull and moves to the center of the coil against a stop or pole piece. The pole piece provides a stop for plunger movement. However, it is often required in a solenoid application that the plunger be retained or held against the pole piece. In order to retain the plunger against the pole piece, a sufficient amount of electrical voltage must be continuously applied to the coil assembly.

To accomplish the plunger hold function, prior art solenoids have included two (2) coil assemblies. A first voltage is applied to the first coil assembly thereby causing the solenoid to perform its work, i.e. the movement of the plunger from its initial position to the pole piece. A second voltage is then applied to the second coil to retain the plunger in its position against the pole piece. The first coil is typically comprised of a heavier gage wire to provide greater ampere turns whereas the second coil is comprised of a lighter gage wire with fewer ampere turns. The first voltage is typically a relatively high voltage and the second voltage is a lower voltage. Solenoids having two coil assemblies have drawbacks including increased expense, increased size, increased weight, and the necessity for entire replacement when one coil burns out (even though the other coil is intact).

Other prior art devices utilize a single coil assembly solenoid, but also provide a control module that applies a high voltage to the coil assembly to perform the work and a lower voltage to the solenoid to perform the hold function. Typically, these dedicated controllers are neither robust nor equipped with versatile connection means to allow use with a broad range of solenoid coils. These prior art devices all exhibit various limitations that the present invention overcomes including a narrow operation voltage range and susceptibility to damage if connected to the power source with improper polarity.

The present invention provides further enhancements in that it allows for direct and continuous connection of the primary power source to the module's power input terminal and also for fixed and continuous connection of the solenoid coil(s) to the module. Control of the application of electrical energy to the solenoid coil(s) can be accomplished by applying a +8 volt to +30 volt (ground reference) low current (less than 10 milliamps) signal to the auxiliary input terminal of the module. This feature allows solenoid systems to be wired without the need for high current switches or relays to control the primary current to the solenoid which in many cases on engine applications exceeds 50 amps.

Other prior art devices utilize an electronic control module that provides a timed application of high energy to the heavier gage winding of a dual winding or dual coil solenoid; however the heavier winding coil becomes inactive after the initial "pull-in" period. Thereafter, the solenoid operates using only the lighter gage coil resulting in low efficiency. In such a system incorrect connections of the control module to the solenoid coils may result in damage to the solenoid and or the control module.

While pulse width modulation has been utilized in the past to control the movement of a solenoid, a pulse width modulation circuit having the structure and benefits, as set forth below, is believed to be novel. The inventor is not aware of any prior art that teaches the unique combination of components and resulting benefits.

SUMMARY OF THE INVENTION

It is an object of the present invention to provide a solenoid control module that can supply a solenoid with a first voltage to perform mechanical work and a second voltage to perform a mechanical hold function without prematurely burning out the solenoid coil assembly. It is a further object to provide a control module that can be used with both single and double coil assembly solenoids. It is a further object to provide a control module that will not damage or destroy the solenoid if the solenoid is improperly connected to the control module output. It is a further object to provide a control module that will not be damaged or destroyed if connected to the power source with improper polarity. It is a yet further object to provide a solenoid module that is well suited for applications in the internal combustion engine industry. For example, diesel engines often require solenoid to operate fuel on/off levers. Many engine applications require remote or automatic operation of throttle levers. These solenoids must be able to perform a specified amount of work during the retraction or extension of the solenoid plunger and then hold the plunger in a predetermined position for an extended period of time.

These and other objects are achieved by the present invention wherein an electrical control module supplies two different voltages to a single coil or double coil solenoid.

In one embodiment, the invention may be described as an electric circuit for controlling a solenoid including a first voltage control means for providing a first electrical voltage to the solenoid for a predetermined time period; the first voltage control means being connected to the solenoid; a second voltage control means for providing a second electrical voltage to the solenoid; the second voltage control means also being connected to the solenoid; and the second voltage being a pulse width modulated voltage. The second means may include a free wheeling diode for maintaining a continuous current through the solenoid during pulse width modulation with reduced power dissipation and improved magnetic drive to the solenoid. In a preferred embodiment, the free wheeling diode is a Schottky diode. A transient voltage suppressing means may be provided for protecting the circuit from an over voltage condition. In another preferred embodiment, the transient voltage suppressing means is a transient absorption zener diode.

The circuit includes a first, a second and a third output connections, said first and second output connections being adaptable for connection to a single coil solenoid and said first, second and third connections being adaptable for connection to a double coil solenoid. Resistor means and capacitor means are provided to determine the predetermined time period of the first voltage control means.

The circuit preferably includes reverse polarity protection means associated with said first and second voltage control means for opening said circuit in the event that the polarity of said circuit is reversed. A fuse may also be provided, the fuse being sized to open when a reverse polarity condition is detected. In addition, low voltage protection means may be provided for disabling the first and second voltage control means when an inadequate input voltage is supplied to said circuit. The input voltage is preferably in the range of 8 volts to 30 volts.

In another embodiment, the solenoid control circuit comprises two switching means; a semi-conductor means for providing a mono-stable and an a-stable signal to said switching means; a voltage supply source being switchably connected to said solenoid; said semi-conductor means being connected to said switching means; said switching means being connected to said solenoid; said mono-stable signal supplying a constant voltage to said solenoid for a predetermined time period; and said a-stable signal providing a pulse width modulated voltage to said solenoid at the expiration of the predetermined time period.

In a third embodiment, a system for controlling the voltage applied to a solenoid includes a voltage supply source; a voltage control means, said voltage control means being connected to said voltage supply source; and first and second switching means, said first and second switching means being connected to said voltage control means and to said solenoid. The voltage control means is capable of supplying a predetermined mono-stable signal to said first and second switching means and an a-stable signal to said first and second switching means for producing a constant voltage output and a pulse width modulated voltage output respectively. The system may include a free wheeling diode, the free wheeling diode being connected to said first and second switching means. In a preferred embodiment, the free wheeling diode is a Schottky diode.

DETAILED DESCRIPTION

Figure 1:
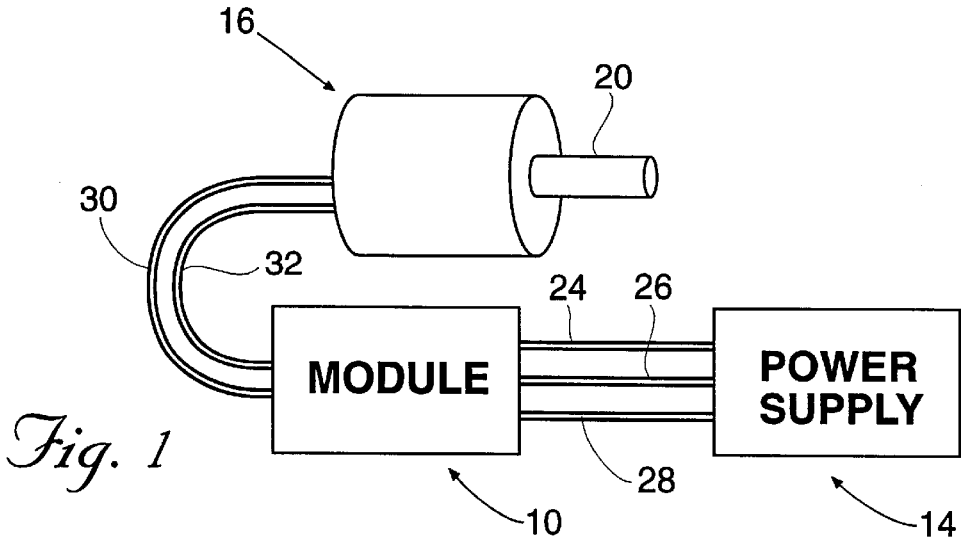
FIG. 1 is a diagrammatic view of a single coil solenoid, the control module and a power supply showing the solenoid plunger fully extended.

Although the disclosure hereof is detailed and exact to enable those skilled in the art to practice the invention, the embodiments herein disclosed merely exemplify the invention that may be embodied in other specific structure and/or methodologies. While the preferred embodiment has been described, the details may be changed without departing from the invention, which is defined by the claims.

The present invention, referred to at reference numeral 10 in the figures, is a solenoid control module. The module 10 operates at relatively low direct current voltages (i.e. 8 to 30 volts direct current). The solenoid module 10 supplies and controls the voltage applied to a coil or coils of a solenoid assembly. The module provides a continuous voltage to a solenoid for purposes of performing work and then provides a pulse width modulated voltage to maintain the solenoid in a hold position.

Figure 2:
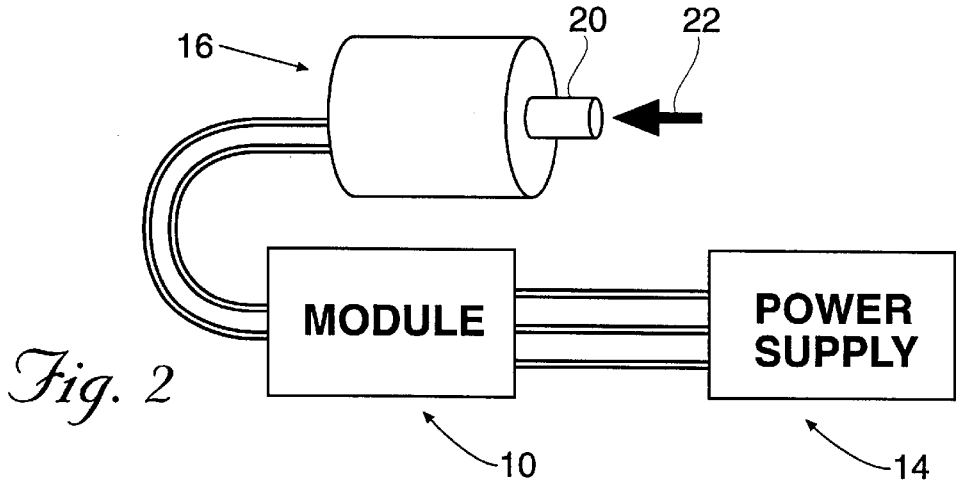
FIG. 2 is a diagrammatic view of a single coil solenoid, the control module and a power supply showing the solenoid plunger being retracted.
Figure 3:
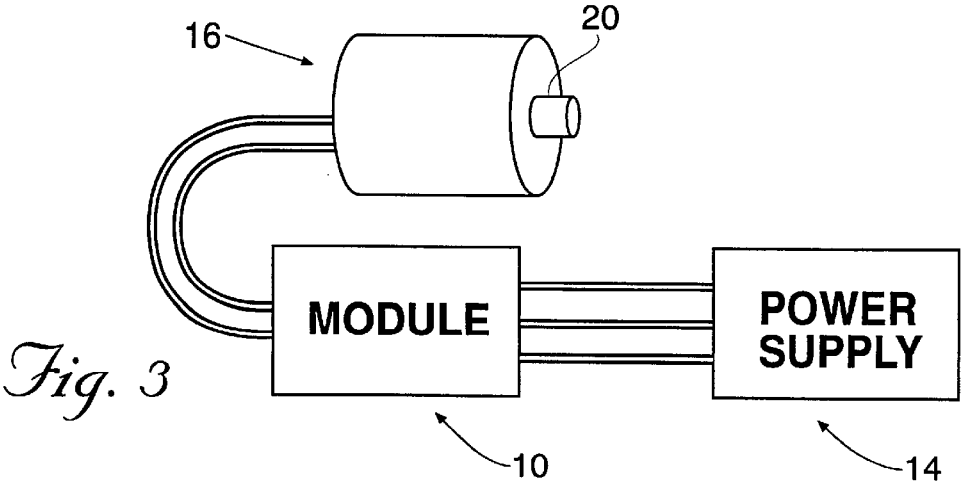
FIG. 3 is a diagrammatic view of a single coil solenoid, the control module and a power supply showing the solenoid plunger in the "hold" position.
Figure 1A:
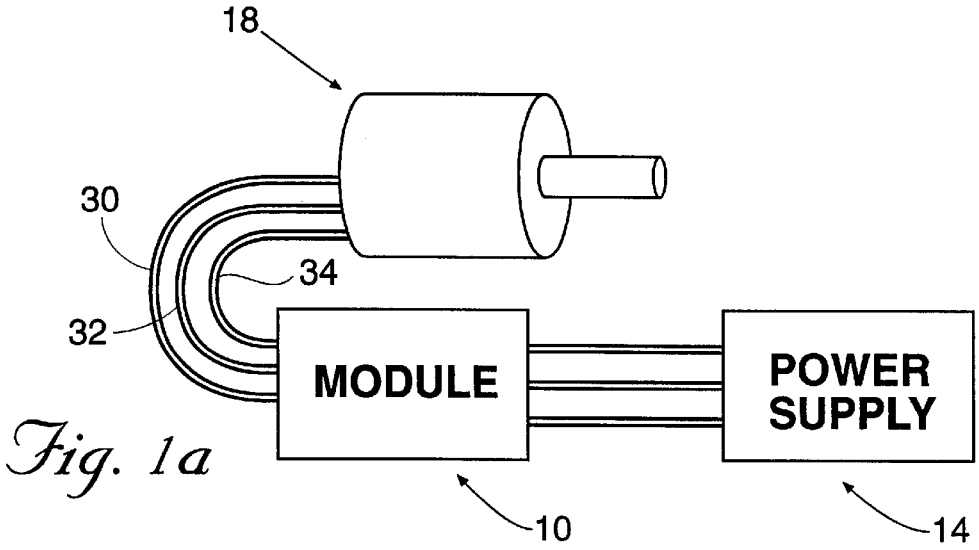
FIG. 1*a* is a diagrammatic view of a double coil solenoid, the control module and a power supply showing the solenoid plunger fully extended.
Figure 2A:
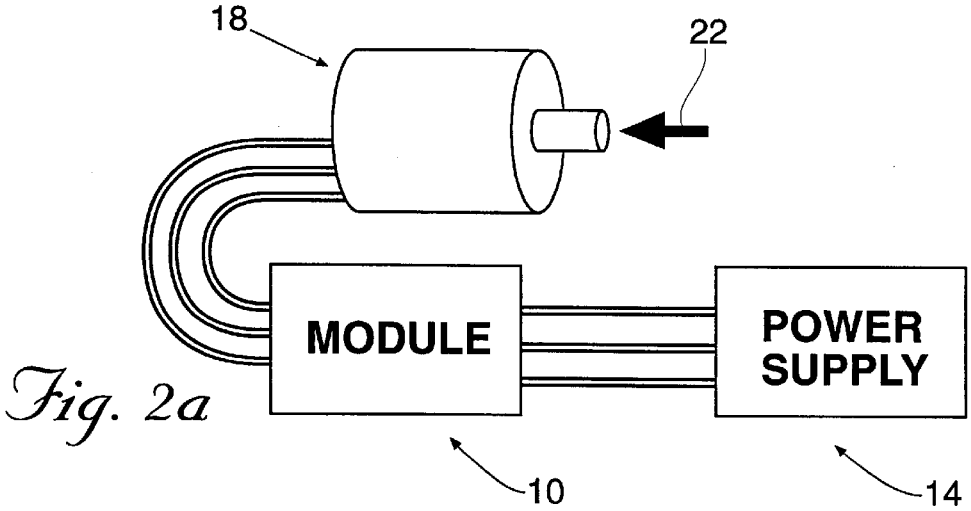
FIG. 2*a* is a diagrammatic view of a double coil solenoid, the control module and a power supply showing the solenoid plunger being retracted.
Figure 3A:
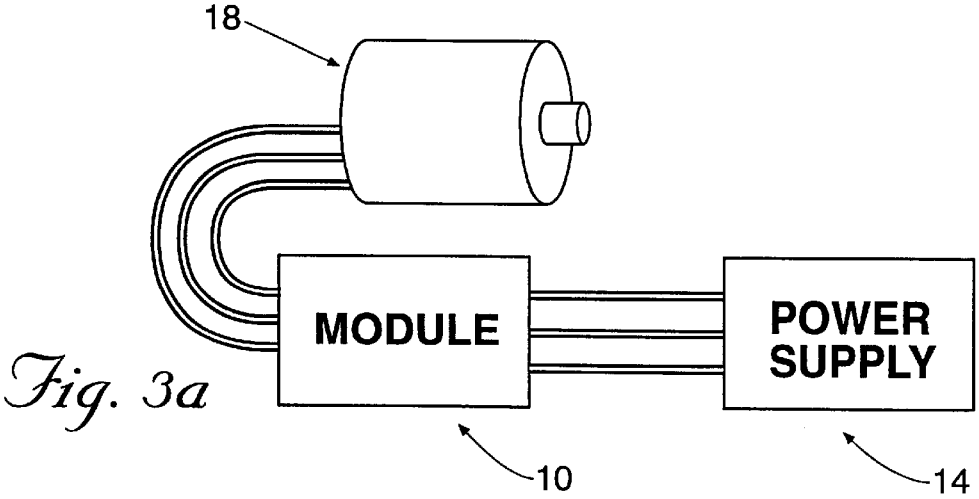
FIG. 3*a* is a diagrammatic view of a double coil solenoid, the control module and a power supply showing the solenoid plunger in the "hold" position.

As shown in FIGS. 1 through 3, a power supply 14 provides an input voltage to the module 10 that in turn supplies voltage to a single coil solenoid 16. As shown in FIGS. 1*a* through 3*a*, a power supply 14 provides an input voltage to the module 10 that in turn supplies voltage to a double coil solenoid 18.

FIG. 1 shows a single coil solenoid 16 having a solenoid plunger 20 where no voltage has been supplied to the solenoid. In FIG. 2, a predetermined voltage has been applied to the solenoid 16, thereby causing the solenoid plunger 20 to retract as shown by arrow 22. In FIG. 3, the solenoid plunger 20 is in the hold mode and a predetermined pulse width modulated voltage is applied to the solenoid coil assembly. FIGS. 1*a*–3*a* are similar to FIG. 1–3, except that a double coil solenoid 18 is shown.

The voltage and current are carried from the power source 14 through wires 24, 26 and 28. Wire 24 is the positive input, wire 26 is the auxiliary positive input and wire 28 is the negative input. The module 10 has two or three output connections, depending upon whether it is to be attached to a single coil (FIGS. 1–3) or a double coil (FIGS. 1*a*–3*a*) solenoid. In a single coil application output connections 30 and 32 are utilized. Output 30 is the ground or neutral output. In a typical solenoid application, the wire connected to output 30 is black. Connection 32 is the working voltage and hold voltage connection that supplies a predetermined voltage to the solenoid 16. In common solenoid applications, the wire connected to connection 32 is white. For double solenoid applications, a third output is present. Additional wire 34 is the "hold" voltage wire. In common applications, the wire connected to output 34 is red.

Figure 4:
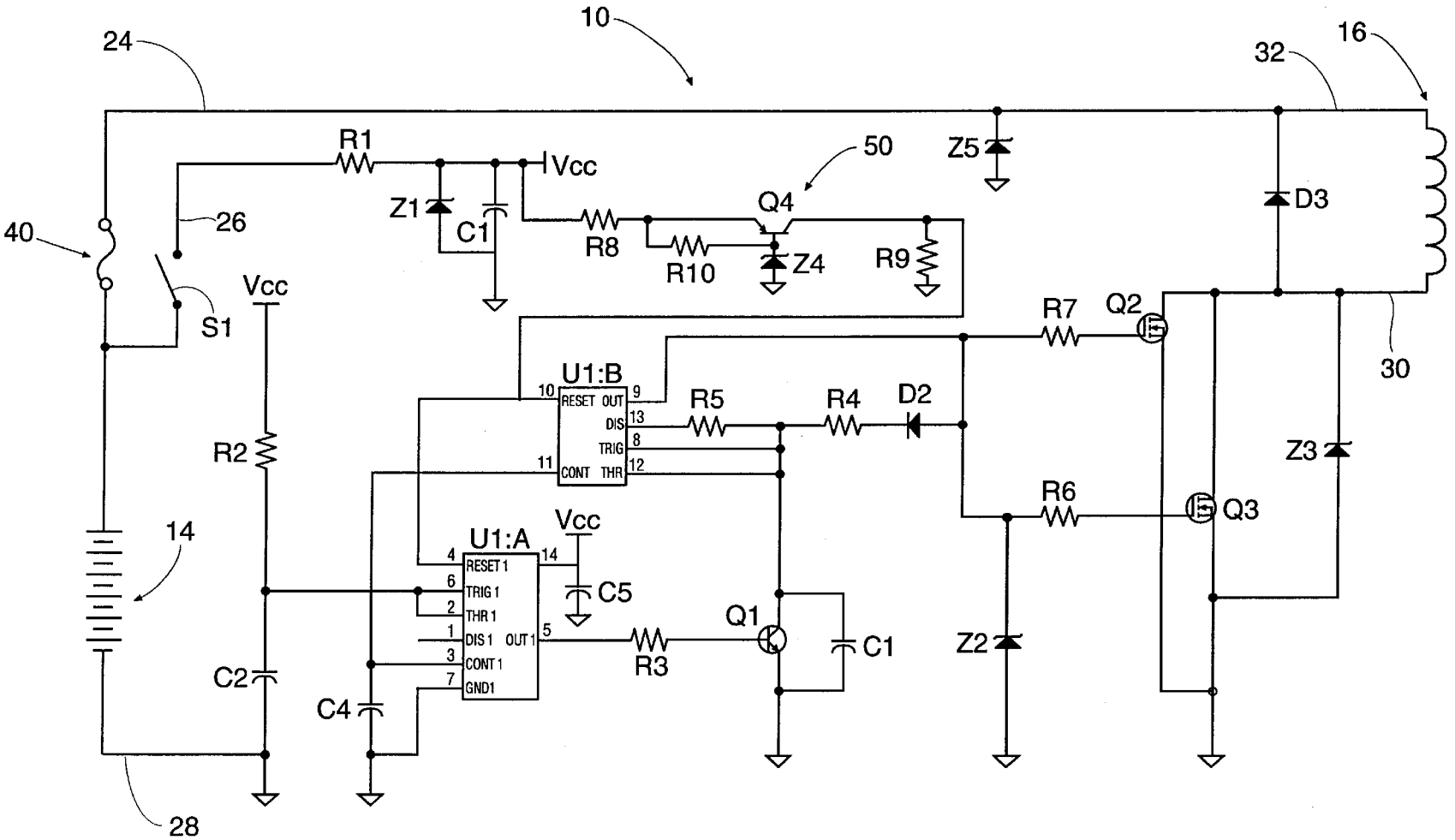
FIG. 4 is a detailed schematic circuit diagram of the control module of the present invention connected to a single coil solenoid.
Figure 5:
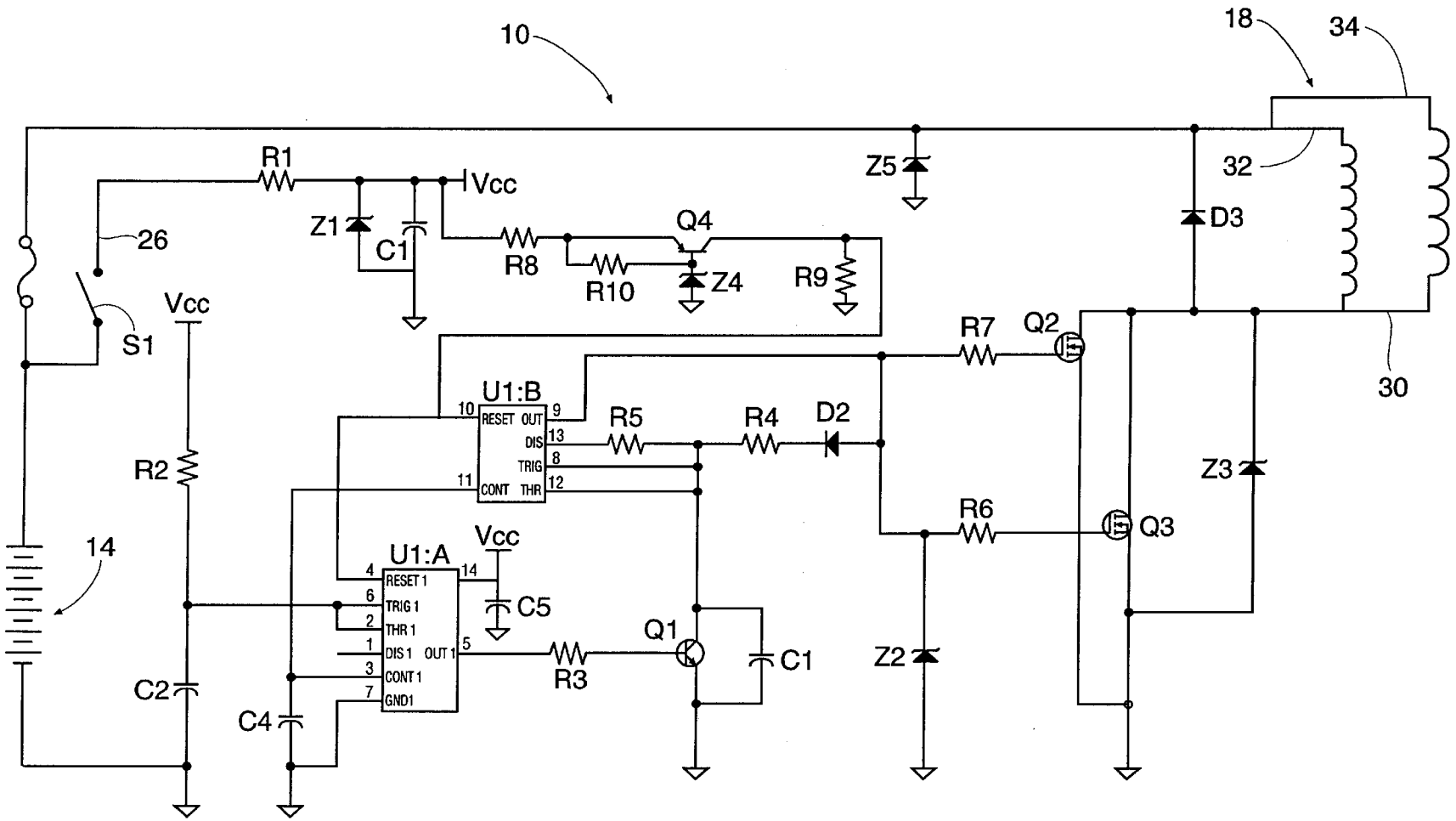
FIG. 5 is a detailed schematic circuit diagram of the control module of the present invention connected to a dual coil solenoid.

The solenoid control circuit 10 shown in FIG. 4 ultimately controls the voltage supplied to the coil of a single coil solenoid 16. An identical solenoid control circuit 10 shown in FIG. 5 controls the voltage supplied to the coils of a dual or two-coil solenoid 18. The only appreciable difference between the circuit shown in FIG. 4 and the circuit shown in FIG. 5 is the provision of output connection 34 in FIG. 5. The amount of voltage and form of the voltage supplied to the solenoid is controlled by the circuit 10. For purposes of illustration only, the circuit set forth below will be described to receive power from a twelve (12) volt power source such as a lead-acid battery. It is to be understood that the output of a lead-acid battery and its supporting charging system in engine installations can vary from between approximately eight (8) volts to approximately sixteen (16) volts. Furthermore, it is to be expressly understood that this circuit, being universal in nature, can be used as presented in a twenty-four (24) volt installation and further more could be adapted for use with other voltage sources and voltage levels.

Referring now to FIG. 4, input voltage is supplied to the circuit 10 at lines 24, 26 and 28. A constant 12-volt positive input is supplied by a battery or other power source 14 at line 24. A constant 12-volt negative input is supplied by the battery or other power source 14 at line 28. An auxiliary 12-volt positive input is also supplied at line 26 to the circuit 10 line switch S1 is energized. For example, switch S1 may be energized by an ignition switch being turned to the "on" position, by a signal received from a remote operator station, or by receiving a signal from a outside source (i.e. receiving a signal from the engine to which the solenoid is attached).

Z5, a zener diode type transient voltage suppressor is connected in between the two primary power inputs, lines 24 and 28. Z5 serves dual purposes. When the primary power source 14 is connected and polarity is proper, Z5 functions as a transient voltage protection device. Should abnormalities occur in the primary power source 14, Z5 will limit positive voltage excursions to approximately forty eight (48) volts thereby protecting other components in the circuit 10. Devices within the family of components that Z5 comes from are available in a broad variety of voltage ratings. Z5 is sized so as to have considerable maximum forward current capability so that it might perform its second function which is to protect the circuit 10 from reverse polarity connection to power source 14.

It is recommended that a fuse 40 be installed in the wiring between the positive battery output and line 24. In the preferred embodiment, the fuse 40 is a 10 or 12 amp slow blow fuse. In combination with fuse 40, transient absorption zener diode Z5 also performs the function of reverse voltage protection. In the event that the installer connects module 10 to power source 14 in an incorrect manner, transient absorptions zener diode Z5 will go into forward conduction and thereby clamp the negative battery voltage down to approximately one (1) volt to protect the circuit 10 from damage. At the same time the transient absorption zener diode Z5 is performing its voltage clamping function, fuse 40 will blow thereby cutting off all voltage to the module 10. Z5 is located physically very close to the power source input terminals so as to minimize heat on the traces of the circuit board under such a fault condition.

Similar functionality can be achieved through use of a lower current capacity transient voltage suppression device in conjunction with a standard rectifier diode connected with a cathode to line 24 and an anode to line 28. The present embodiment is preferred in that it reduces the number of components and circuit board space consumption while at the same time providing a robust level of transient energy protection.

The 12-volt positive auxiliary input line 26 supplies a positive voltage into the circuit 10 when activated by switch S1. The combination of resistor R1 and zener diode Z1 protects the circuit 10 from an over-voltage condition or reverse polarity connection on line 26. Capacitor C1 provides a small amount of energy storage so that if there is a brief current or voltage interruption in line 24, the capacitor will maintain the line.

The combination of resistor R8, resistor R10, transistor Q4, zener diode Z4 and resistor R9 form a low voltage supply protection circuit 50. If the voltage in the circuit 10 falls to a low level, which can cause damage to the MOSFET transistors Q2 and Q3 due to inadequate gate drive voltage, the low voltage supply circuit 50 will shut off the circuit 10 until a higher voltage level is achieved. MOSFET transistors Q2 and Q3, discussed in detail below, must be supplied with a minimum gate to source voltage. If supplied with a voltage that is less than the minimum required gate to source voltage, the MOSFET transistors Q2 and Q3 will act as linear amplifiers, not as switches as required. U1:B, also discussed in detail below, is the driver for MOSFET transistors Q2 and Q3. The low voltage supply circuit 50 will turn U1:B off if the voltage falls below the minimum level of approximately 8 volts.

The primary power source negative input line 28 provides a ground to the circuit 10. This a common ground for the entire circuit (as shown in the schematic) and is also the ground reference for VCC or the controlled voltage. Referring back to the description of zener diode Z1, it will be appreciated that VCC will never exceed the voltage rating of Z1.

A 556 CMOS chip having 14 pins is shown at U1:A and U1:B. The chip performs two distinct functions. It acts as both an a-stable multi-vibrator constantly toggling between an on and off stage and as a one shot or mono-stable multi-vibrator. Both functions will be discussed below.

As will become evident during the following discussion, voltage is not supplied to the coil assembly of the coil 16 until the MOSFET transistors Q2 and Q3 have been energized. Without being energized, the coil 16 is not connected to ground. U1:B is the driver that provides current to the gates of the MOSFET transistors Q2 and Q3.

U1:B in conjunction with R4, R5, D2 and C3 comprises an a-stable multi-vibrator. In the absence of Q1, or with Q1 in a non-conducting state, U1:B's output continuously toggles between the on and off state. When full power is required at solenoid 16 (i.e. during the "pull-in" or work period), the U1:A output turns on the base of transistor Q1. This in turn shunts capacitor C3 and thus forces a low voltage condition at the "trigger" pin (pin8) of U1:B which forces U1:B to its "on" state. With U1:B stalled in its "on" state, MOSFET transistors Q2 and Q3 are in full conduction providing a path of continuous current flow to solenoid 16. The path of current flow is from the positive terminal of the power source 14, through the solenoid 16, through Q2 and Q3, and back to the negative terminal of the power source 14. With this uninterrupted supply of voltage, solenoid 16 performs its work of retracting or "pulling in" its plunger 20 as illustrated in FIGS. 2/2*a*.

U1:A in conjunction with R2 and C2 comprises a monostable multi-vibrator or "oneshot" device. Its preset on time determines the solenoid "pull in" or work period. Prior to closing switch S1, VCC is zero. C2 is initially at zero or discharged. When switch S1 is turned on, C2 charges through R2 toward the VCC maximum level (i.e. approximately 12 volts). Capacitor C2 acts as the timer for the predetermined solenoid work period. When the voltage on C2 is less than one-third (⅓) VCC, the output pin 5 of U1:A chip is on. When the voltage on C2 reaches two-thirds (⅔) VCC, U1:A output at pin 5 turns off. U1:A output, when "on", directs current through R3 and biases Q1 on. At the two-thirds VCC level on C2, the output is turned off, yet capacitor C2 continues to charge to VCC level and then stays at the VCC level. As an aside, when VCC is removed (i.e. the circuit is de-energized) C2 discharges over time.

The "pull in" period lasts for a predetermined period of time. In circuit 10, the "pull-in" period is approximately one-half second. After the "pull in" period has expired, U1:B operates as an a-stable multi-vibrator to supply a pulse width modulated voltage to the solenoid 16. Resistor R4, resistor R5 and capacitor C3 set the frequency and duty cycle of the pulse width modulated voltage. Rectifier diode D2 is provided to allow the circuit 10 to operate at less than fifty percent (50%) duty cycle. When the output of U1:B is off or conducting to ground. D2 prevents current flow from C3 through R4 to U1:B output pin 9.

As stated above, U1:B functions as the driver that provides current to the gates of MOSFET transistors Q2 and Q3. When the output of U1:B is high, capacitor C3 is charging. When the charge on capacitor C3 equals two-thirds VCC, U1:B turns on a discharge path through resistor R5 and pin 13. At the same time, U1:B turns its output to the off state. This is accomplished within the CMOS chip by tying the output to ground through an internal transistor.

Capacitor C3 continues to discharge until its output equals one-third VCC. At this point, U1:B turns its output back on and turns its discharge path off. It will be appreciated that capacitor C3 and resistor R5 control the off time while the combination of capacitor C3, resistor R4 and diode D2 control the on time. The ratio of resistor R4 as compared to resistor R5 sets the duty cycle. Capacitor C3 controls the frequency of the pulse width modulated signal. The U1:B output is on as C3 charges between one-third VCC and two-thirds VCC; U1:B output is off as C3 discharges from two-thirds (⅔) to one-third (⅓) VCC. Resistor R6 and resistor R7 balance the MOSFET transistors Q2 and Q3 to make sure each transistor is doing approximately the same work as the other.

C4 functions as a random noise bypass device for any unwanted noise to prevent noise from affecting the 556 timer. It should be noted that C4 is tied to both control outputs. C5 functions as a bypass device for high frequency noise on VCC. Z2 is simply a precautionary element in the circuit. It protects the gates of Q2 and Q3 against damage from voltage transients. Z3 is a transient voltage protection device. It protects Q2 and Q3 from static and unexpected high voltage input at solenoid connection point 30. For example, a static charge generated by the installer of the controller or solenoid.

In the preferred embodiment, the pull time generated from R2 and C2 is approximately one-half (½) second. By changing the value of R2 and C2, the work or pull time can be varied widely, but for typical applications the time is generally in the range of 0.1 seconds to 3 seconds.

D3 is a Schottky diode. It provides a path for continuous current to flow through the solenoid coil or coils 16/18 each time Q2 and Q3 switch from their conducting state to their non-conducting state (i.e. on and off). A Schottky diode is chosen as the freewheeling diode in the present invention predominately for two reasons: reduced power dissipation in the diode itself and improved magnetic drive in the solenoid 16 under reduced voltage operating conditions.

Both cited benefits derive from the lower forward voltage drop exhibited by the Schottky device. In a typical high energy solenoid application, continuous coil current when the solenoid is holding a load in position is of a magnitude of several amps. Whereas an appropriately sized standard fast recovery rectifier might exhibit a forward voltage drop of about one (1) volt, a similarly sized Schottky diode would exhibit a forward drop of approximately one-half (0.5) volts. This means that at a given current level, the Schottky device is dissipating about one-half the power and thereby generating one-half the heat output as compared to the standard device. If both devices are constructed using the same mechanical structure (i.e. a JEDEC TO-220 package) and implying the package will exhibit the same thermal resistance junction to ambient, then the temperature rise of Schottky device will be one-half that of the standard fast recovery diode. This ultimately allows the use of a smaller device or a reduction or elimination of heat sink provisions when using the Schottky diode. The net result includes, among other benefits, lower cost and a smaller end product.

In regard to improved magnetic drive in the solenoid 16 under reduced voltage the following analysis illustrates the point. In the case of the preferred embodiment 10 described herein, the pulse width modulated duty cycle in the continuous hold mode is thirteen percent (13%). This means that the power MOSFETs within the module 10 connects the solenoid coil to the supply voltage source 14 thirteen percent (13%) of the time. Ignoring conduction losses, the voltage across the coil equals supply voltage during that time. The polarity of the impressed voltage is such that it reverse biases the freewheeling diode to a non-conducting state. The remaining eighty seven percent (87%) of the time, the power MOSFETs are switched off thereby disconnecting the solenoid 16 from the primary voltage source 14. When this occurs, coil current declines resulting in magnetic field collapse around the solenoid coil. This in turn causes a reversal of the voltage across the coil. This reverse polarity voltage rises in magnitude until it reaches a value sufficient to forward bias the freewheeling diode, bringing it into conduction. Once forward biased into conduction, the diode allows maintenance of current in the solenoid coil. The current path is localized to the coil and the freewheeling diode. During this time the voltage across the solenoid coil equals the forward voltage drop of the freewheeling diode; but, polarity is the inverse of that present when the MOSFETs are conducting.

Assuming the power source 14 is a twelve volt battery (that may reduce in voltage depending upon battery load and the supportive charging system), the following situations occur.

Standard diode, battery supply at 12 volts:

Vcoil=12V (Vsupply)×0.13(13% on time)−1.0V (Vf diode)×0.87(87% off time)=0.69 volts (average)

Schottky diode, battery supply at 12 volts:

Vcoil=12V (Vsupply)×0.13(13% on time)−0.5 V (Vf diode)×0.87 (87% off time)=1.125 volts (average)

Standard diode, battery supply reduced to 8 volts:

Vcoil=8V (Vsupply)×0.13(13% on time)−1.0V (Vf diode)×0.87 (87% off time)=0.170 volts (average)

Schottky diode, battery supply reduce to 8 volts:

Vcoil=8V (Vsupply)×0.13 (13% on time)−0.5 V (Vf diode)×0.87 (87% off time)=0.605 volts (average)

where Vcoil is the voltage supplied to the solenoid coil; Vsupply is the supply voltage; and Vf is the forward voltage drop of the diode.

The thirteen percent (13%) duty cycle is chosen to provide the best all around performance of the module 10 across it's full specified operating range of 8 to 30 volts. The above calculations show that the use of the Schottky diode at D3 provides far superior performance in respect to maintaining voltage to the solenoid coil under reduced operating voltage conditions. The solenoid's hold strength is directly related to the average voltage supplied to the coil. Therefore, it maintains acceptable performance much longer with a faltering voltage supply when a Schottky diode is used at D3.

The following is a list of exemplary components that may be used in the circuits illustrated in FIGS. 4 and 5. These components are merely exemplary and other components could be utilized or readily substituted without departing from the scope of the present invention.

Exemplary Components

Resistors
R1 510 Ohms, 2 watt
R2 226 kOhms, ¼ watt
R3 30.1 kOhms, ¼ watt
R4 13.0 kOhms, ¼ watt
R5 100 kOhms, ¼ watt
R6 46.4 Ohms, ¼ watt
R7 46.4 Ohms, ¼ watt
R8 4.12 kOhms, ¼ watt
R9 100 kOhms, ¼ watt
R10 39.2 kOhms, ¼ watt
Capacitors
C1 2.2 micro F, 25 volt
C2 2.2 micro F, 25 volt
C3 0.01 micro F, 50 volt
C4 0.01 micro F, 50 volt
C5 0.01 micro F, 50 volt
Diodes
Z1 Zener Diode, 12 volt, 1 watt
Z2 Zener Diode, 15 volt, ½ watt
Z3 Transorb, 600 watt unidirectional, 34 volt min VBR, 49.9 volt max clamp
Z4 Zener Diode, 6.2 volt, ½ watt
Z5 Zener Diode 5000 watt unidirectional, 33.3 volt min VBR, 48.4 volt max clamp
Transistors
Q1 40 volt, 500 ma
Q2 Power MOSFET, 55 volt, 64 amp, 0.016 ohm, RDS (on), 140 watt
Q3 Power MOSFET, 55 volt, 64 amp, 0.016 ohm, RDS (on), 140 watt
Q4 Tansistor, NPN, 40 volt, 500 ma
Rectifier Diodes
D2 0.2 amp, 250 volt
D3 Schottky rectifier, 20 amp, 45 volt
Integrated Circuits
U1:A/U1:B CMOS 556 IC Dual Timer, 14 pin DIP While the invention has been described in conjunction with a specific embodiment, it is to be understood that many alternatives, modifications, and variations will be apparent to those skilled in the art in light of the foregoing description. For example, without departing from the invention, the CMOS 556 IC Dual Timer could be replaced with two (2) CMOS 555 timers. Accordingly, this invention is intended to embrace all such alternatives, modifications, and variations which fall within the spirit and scope of the following claims. As another example, the effect of the mono-stable and a-stable multi-vibrations could be duplicated using a digital micro-controller in place of the 556 timer and related resistors and capacitors. As yet another example a single more robust power MOSFET could be used to replace the two power MOSFETs (Q2 and Q3).

What is claimed is:

1. An electric circuit for controlling a solenoid, the circuit comprising:

a first voltage control means for providing a first electrical voltage to the solenoid for a predetermined time period;

the first means being connected to the solenoid;

a second voltage control means for providing a second electrical voltage to the solenoid;

the second means being connected to the solenoid; and the second voltage being a pulse width modulated voltage.

2. The circuit of claim 1 wherein the second means further includes a free wheeling diode for maintaining current flow through the solenoid thereby maintaining a magnetic field around the coil when the pulse width modulation voltage cycles off.

3. The circuit of claim 2 wherein the free wheeling diode is a Schottky diode.

4. The circuit of claim 1 further comprising transient voltage suppressing means for protecting said circuit from an over voltage condition;

the transient voltage suppressing means being connected to the solenoid.

5. The circuit of claim 4 wherein the transient voltage suppressing means is a transient absorption zener diode.

6. The circuit of claim 1 further including a first, a second and a third output connection, said first and second output connections being adaptable for connection to a single coil solenoid and said first, second and third connections being adaptable for connection to a double coil solenoid.

7. The circuit of claim 1 further including resistor means and capacitor means, said resistor and capacitor means being connected to said circuit and wherein the predetermined time period is determined by said capacitor and resistor means.

8. The circuit of claim 1 further including reverse polarity protection means associated with said first and second voltage control means for opening an external protective fuse wired in series with said circuit in the event that input polarity to said circuit is reversed.

9. The circuit means of claim 1 further including low voltage protection means associated with said first and second voltage control means for disabling said first and second voltage control means when inadequate input voltage is supplied to said circuit.

10. The circuit of claim 1 further including an input voltage source, the input voltage source being in the range of 8 volts to 30 volts.

11. The circuit of claim 10 wherein the input voltage source is 12 volts.

12. The circuit of claim 10 wherein the input voltage source is 24 volts.

13. The circuit claim of claim 1 further including an auxiliary control input for supplying an auxiliary control input signal to said circuit;

said auxiliary control input signal providing the low current control signal to exercise complete on and off control of said circuit; and said auxiliary control connection being connected to said circuit.

14. A solenoid control circuit connected to a solenoid and a voltage supply source, said circuit comprising:

at least one switching means;

a semi-conductor means for providing a mono-stable and an a-stable signal to said switching means;

said semi-conductor means being connected to said switching means;

said switching means being connected to said solenoid;

said mono-stable signal supplying a constant voltage to said solenoid for a predetermined time period; and said a-stable signal providing a pulse width modulated voltage to said solenoid at the expiration of the predetermined time period.

15. The circuit of claim 14 further including a free wheeling diode for maintaining a continuous current through the solenoid after the predetermined time period;

the free wheeling diode being connected to the switching means.

16. The circuit of claim 14 wherein the free wheeling diode is a Schottky diode.

17. The circuit of claim 14 further comprising transient voltage suppressing means for protecting said circuit from an over voltage condition.

18. The circuit of claim 17 wherein the transient voltage suppressing means is a transient absorption zener diode.

19. The circuit of claim 14 further including a first, a second and a third output connection, said first and second output connections being adaptable for connection to a single coil solenoid and said first, second and third connections being adaptable for connection to a double coil solenoid.

20. The circuit of claim 14 further including resistor means and capacitor means, said resistor and capacitor means being connected to said circuit and wherein the predetermined time period is determined by said capacitor and resistor means.

21. The circuit of claim 14 further including reverse polarity protection means associated with said voltage supply source for opening a supply fuse in the event that said circuit is reversely connected to said voltage supply source.

22. The circuit of claim 21 further including low voltage protection means associated with said semi-conductor means for disabling said semi-conductor means when inadequate input voltage is supplied to said circuit.

23. The circuit of claim 14 further including an auxiliary control input for supplying an auxiliary control input signal to said circuit;

said auxiliary control input signal providing the low current control signal to exercise complete on and off control of said circuit; and said auxiliary control connection being connected to said circuit.

24. A system for controlling the voltage applied to a solenoid, the system comprising:

a voltage supply source;

a voltage control means capable of supplying a predetermined mono-stable signal to said switching means and an a-stable signal to said switching means for producing a constant voltage output and a pulse width modulated voltage output, said voltage control means being connected to said voltage supply source;

at least one switching means, said switching means being connected to said voltage control means and to said solenoid.

25. The system of claim 24 further including a free wheeling diode, the free wheeling diode being connected to said switching means.

26. The system of claim 25 wherein the free wheeling diode is a Schottky diode.

* * * * *

UNITED STATES PATENT AND TRADEMARK OFFICE

CERTIFICATE OF CORRECTION

PATENT NO. : 6,256,185 B1
DATED : July 3, 2001
INVENTOR(S) : Dennis A. Maller

It is certified that error appears in the above-identified patent and that said Letters Patent is hereby corrected as shown below:

On Page 4, lower middle of Figure 4, and the image of Figure 4 on Page 1, please revise by deleting "C1" and inserting "C3" as shown:

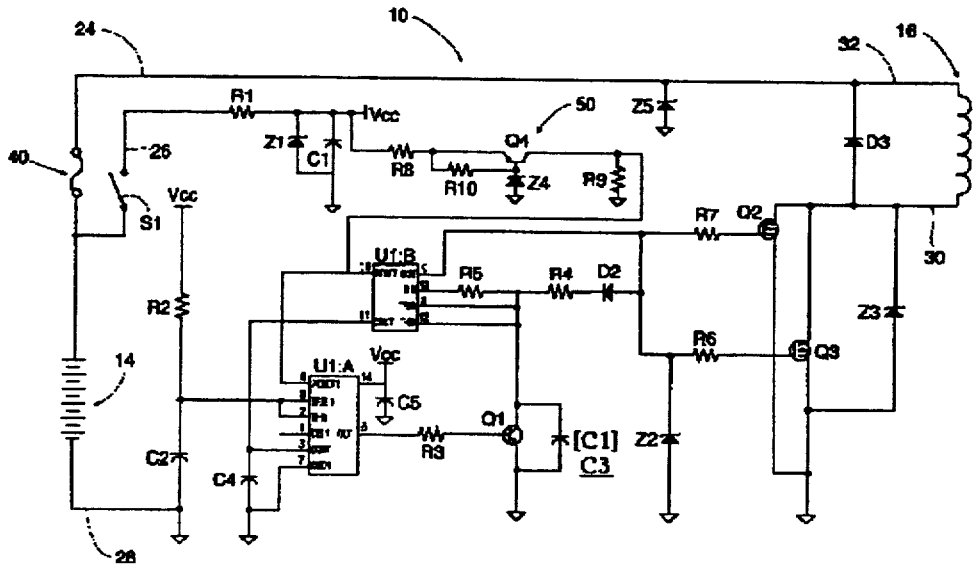

*Fig. 4*

Note that the correct item "C1" is located in the upper left quadrant of the Figure.

-and-

UNITED STATES PATENT AND TRADEMARK OFFICE

CERTIFICATE OF CORRECTION

PATENT NO. : 6,256,185 B1
DATED : July 3, 2001
INVENTOR(S) : Dennis A. Maller

It is certified that error appears in the above-identified patent and that said Letters Patent is hereby corrected as shown below:

Similarly, on Page 5, lower middle of Figure 5, please revise by deleting "C1" and inserting "C3" as shown:

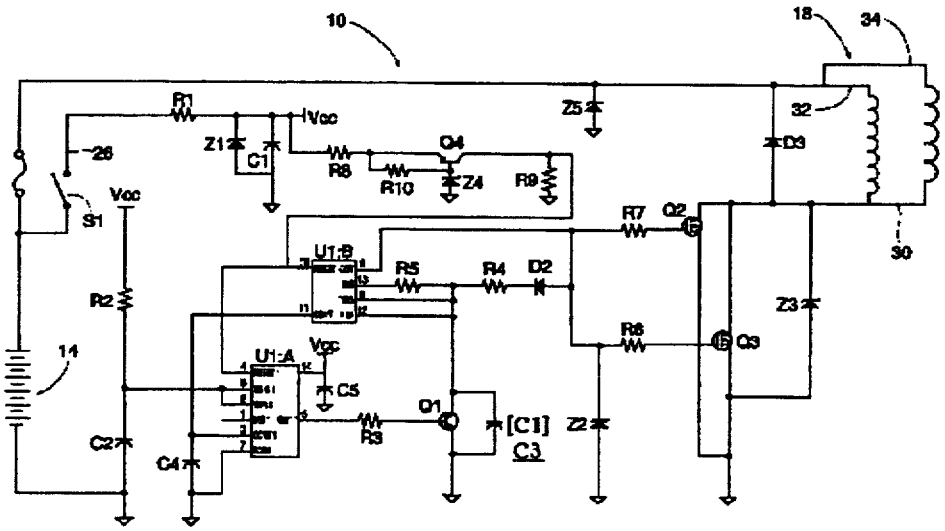

*Fig. 5*

Note that the correct item "C1" is located in the upper left quadrant of the Figure.

Signed and Sealed this

Twenty-second Day of January, 2002

*Attest:*

*Attesting Officer*

JAMES E. ROGAN
*Director of the United States Patent and Trademark Office*